US006495749B2

(12) United States Patent
Paramonov et al.

(10) Patent No.: US 6,495,749 B2
(45) Date of Patent: Dec. 17, 2002

(54) HYBRID COMBUSTION POWER SYSTEM

(75) Inventors: Dmitry V. Paramonov, Monroeville, PA (US); Mario D Carelli, Greensburg, PA (US); Dennis A. Horazak, Orlando, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 09/822,390

(22) Filed: Mar. 30, 2001

(65) Prior Publication Data

US 2002/0139409 A1 Oct. 3, 2002

(51) Int. Cl.[7] ..... H01L 35/30

(52) U.S. Cl. ..... 136/205; 136/242; 165/911; 310/306

(58) Field of Search ..... 136/205, 242, 136/204; 165/911, 110, 113, 117; 310/306

(56) References Cited

U.S. PATENT DOCUMENTS

| | | | |
|---|---|---|---|
| 4,808,240 A | 2/1989 | Sievers | 136/202 |
| 5,228,922 A | 7/1993 | Sievers | 136/202 |

OTHER PUBLICATIONS

Yamaguchi et al., "New Proposal of High Temperature Thermoelectric Conversion in Power Plants", 18$^{th}$ International Conference on Thermoelectrics, Aug. 1999, pp. 84–87.*

F.N. Huffman, et al. "Topping Cycle Applications of Thermionic Conversion" IECEC '75 Record (Aug. 1975) pp. 496–502, Inst. Electrical & Electronics Engineers, Univ. of Del., Newark, Del.

P. A. Nelson, editor, R.K. Sievers, et al., "High Power Density Alkali Metal Thermal to Electric Converter," Proceedings of 25th Energy Conversion Engineering Conf. (Aug. 1990), vol. 2 pp 426–430, Amer. Inst. Chem. Eng. NY, NY.

R. Decher "Direct Energy Conversion" (1997) pp. 134–161 (Ch 6) & pp. 240–252 (Ch 9), Oxford Univ. Press.

* cited by examiner

*Primary Examiner*—Nam Ngyuyen
*Assistant Examiner*—Thomas H. Parsons

(57) ABSTRACT

Hybrid combustion power systems comprising multiple direct energy conversion devices are disclosed, which devices (12, 14, 16) are preferably combined with a Rankine cycle containing a steam turbine (114), where combustion air (A) may be continuously preheated by an optional air heater (58), then by the waste heat of a low temperature direct energy conversion device (16) such as an alkali metal thermoelectric converter (AMTEC), and finally by the waste heat of a high temperature direct energy conversion device (12) such as an AMTEC, where the AMTECs include electrolyte (36) may include a condenser located in substantially the same geometrical plane as the AMTEC electrolyte (36) and thermally insulated from the electrolyte.

10 Claims, 5 Drawing Sheets

HYBRID COMBUSTION POWER SYSTEM

BACKGROUND OF THE INVENTION

The present invention relates to power generation systems, and more particularly relates to a hybrid combustion power system including multiple direct energy conversion devices.

DESCRIPTION OF THE RELATED ART

An advantage of simple cycle steam turbine power plants is the ability to burn a wide variety of fossil fuels with relatively minor preconditioning. However, the efficiency of steam plants is limited despite the availability of high temperatures in their fossil fuel burners. A combined gas-steam cycle provides high efficiency, but burns natural gas which is relatively expensive. Utilization of less expensive fuels such as coal requires heavy preconditioning, e.g., integrated gasification combined cycle (IGCC) and pressurized fluidized bed combustion (PFBC), and lowers the overall plant efficiency.

An alternative to IGCC and PFBC technologies would be to use a direct energy conversion topping cycle which has no moving parts and can accept almost any type of fuel. However, direct energy conversion methods have relatively narrow ranges of heat source and heat sink temperatures to achieve efficient operation while ensuring sufficient lifetime and reliability.

SUMMARY OF THE INVENTION

In accordance with the present invention, a hybrid combustion power system comprising multiple direct energy conversion devices is provided. The conversion efficiencies of topping cycles and stand alone power systems are significantly increased by operating the direct energy conversion devices of the system efficiency and reliably at variable heat source and heat sink temperatures.

An aspect of the invention is to provide a hybrid combustion power system including a source of combustion air, a low temperature direct energy conversion device for heating the combustion air, and a high temperature direct energy conversion device for further heating the combustion air.

A further aspect of the invention is to provide a hybrid combustion power system comprising: a source of combustion air, combustion fuel, and coolant; at least one direct energy thermionic converter power generator for heating at least one of the combustion air and coolant; and a steam turbine to which any heated coolant passes.

Another aspect of the invention is to provide an alkali metal thermoelectric converter (AMTEC) having a parallel condenser system comprising: multiple opposing high temperature working fluid regions separated from each other by at least one vapor chamber; and multiple opposing low temperature coolant regions separated from each other by the at least one vapor chamber, and separated from the high temperature working fluid regions by insulating walls. The primary feature of AMTEC is its ability to generate electric power using the temperature difference between a hot stream and a cold stream. The hot stream is cooled as a side effect of the electric conversion process, and the cold stream is heated by waste heat from the AMTEC device. In different parts of this disclosure, some of the waste heat is used to heat combustion air, and some is used to heat feedwater and steam.

These and other aspects of the present invention will be more apparent from the following description.

DETAILED DESCRIPTION

Figure 1:
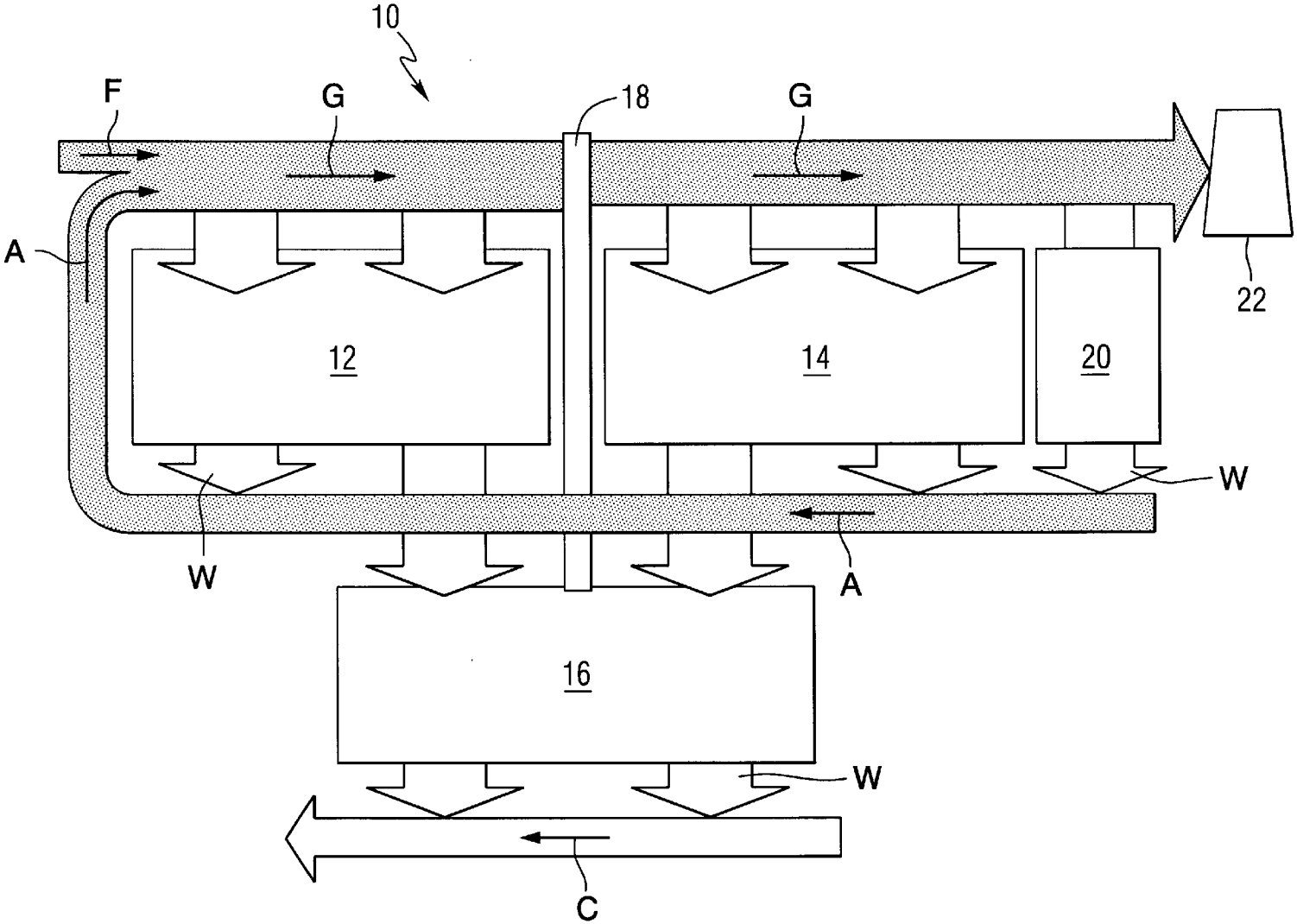
FIG. 1, which best shows the invention, is a schematic diagram of a hybrid combustion power system in accordance with an embodiment of the present invention.

The hybrid combustion power systems of the present invention comprise multiple direct energy conversion devices such as thermoelectric devices and/or AMTEC devices. FIG. 1 schematically illustrates a hybrid combustion power system 10 in accordance with an embodiment of the present invention. The hybrid system 10 includes a high temperature direct energy conversion device 12, a low temperature direct energy conversion device 14, and an optional second low temperature direct energy conversion device 16. The high temperature direct energy conversion device 12 preferably comprises a thermionic device or AMTEC. The low temperature direct energy conversion device 14 preferably comprises an AMTEC or thermoelectric converter. The optional second low temperature direct energy conversion device 16 preferably comprises an AMTEC, thermoelectric or conventional thermophotovoltaic converter, or conventional Rankine cycle. A superheater or reheater 18 may optionally be installed in the hybrid system 10.

Combustion air A, that is, air that is to be combusted with fuel to form combusted gas, is introduced into the system 10 and is mixed with fuel F. The fuel F may be any suitable hydrocarbon fuel such as benzene, gasoline, methane or natural gas. Combusted gas G heats both the high temperature device 12 and the low temperature device 14. The same stream of combustion products is thus preferably used to heat both the devices. The combusted gas G exits the hybrid system 10 through a stack 22. A cooling medium C, such as air or water, flows adjacent to the optional second low temperature direct energy conversion device 16. Waste heat W generated by the various direct energy conversion devices is transferred as illustrated by the several broad arrows shown in FIG. 1.

Preferred operating temperatures for the high temperature direct energy conversion device 12 are from about 1,300 K (1,027° C.) to about 2,500 K (2,227° C.), more preferably from about 1,600 K (1,327° C.) to about 2,000 K (1,727° C.). The operating temperature for the first low temperature direct energy conversion device 14 is preferably from about 600 K (327° C.) to about 1,300 K (1,027° C.), more preferably from about 900 K (627° C.) to about 1,250 K (977° C.).

In accordance with the embodiment of the invention shown in FIG. 1, the combustion air A may be continuously preheated, first by the optional air heater 20, then by the waste heat of the low temperature direct energy conversion device 14, such as an alkali metal thermoelectric converter (e.g., mercury, cesium, rubidium or potassium AMTEC) or other suitable thermoelectric device. The combustion air A is then further heated by the waste heat of the high temperature device 12, such as a thermionic device or a high temperature thermoelectric converter (e.g., lithium AMTEC). The low and high temperature energy conversion devices 14 and 12 preferably receive heat from a conventional fossil fuel burner (not shown).

Because the heat rejection temperature of the high temperature device 12 is higher than that of low temperature device 14, effective recovery of a large portion of their waste heat is achieved. The waste heat not recovered by the combustion air A may be passed to the second low temperature device 16, such as an AMTEC, thermoelectric converter or thermophotovoltaic device, or a Rankine cycle with the optional reheater and/or superheater 18 installed directly in the burner.

Figure 2:
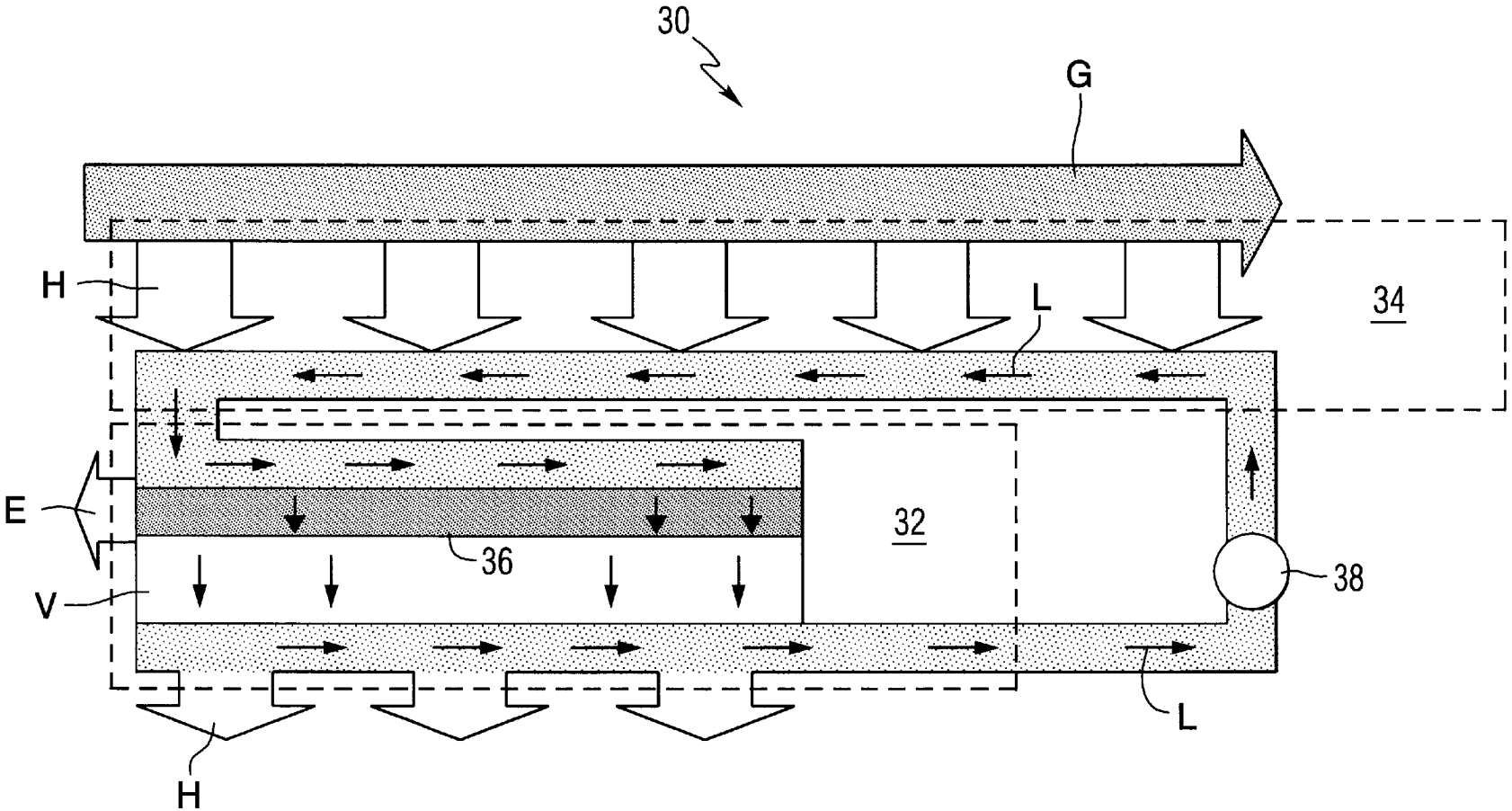
FIG. 2 is a schematic diagram of an isothermal combustion heated alkali metal thermoelectric converter (AMTEC) which may be used in accordance with an embodiment of the present invention.

FIG. 2 schematically illustrates an AMTEC system 30 which may be used as the high and/or low temperature direct energy conversion devices of the present invention. The system 30 includes an AMTEC 32 shown by dashed lines. A heat exchanger 34, also shown by dashed lines, communicates with the AMTEC 32. A solid electrolyte 36 is provided within the AMTEC 32. For high temperature direct energy conversion devices, the solid electrolyte 36 preferably comprises sodium or lithium. For low temperature direct energy conversion devices, the solid electrolyte 36 preferably comprises potassium. A vapor working fluid V is adjacent to the surface of the solid electrolyte 36. The vapor V travels from the surface of the solid electrolyte 36, and condenses as a liquid working fluid L, which is circulated through the system 30 by a pump 38 such as a conventional EM pump. During operation of the AMTEC system 30, heat H is transferred as shown by the several broad arrows in FIG. 2.

In order to accomplish isothermal AMTEC operation at the highest possible temperature while using a non-isothermal heat source, the pressurized AMTEC working fluid L may be heated as it flows in the heat exchanger 34 against the flow of the combusted gases G. Once the working fluid has reached the heat exchanger exit E, it isothermally expands through the AMTEC electrolyte 36, as illustrated in FIG. 2. Such an arrangement offers not only higher device conversion efficiency, but also higher overall system conversion efficiency and power density due to utilization of a large portion of the thermal energy available in the combusted gases G. In the case of a liquefied AMTEC, the heat exchanger may be made of a number of electrically insulated pipes carrying the working fluid to the individual AMTEC assemblies connected in series. If a vapor-fed AMTEC is employed, it is not necessary to place electrical insulation in the heat exchanger.

Figure 3:
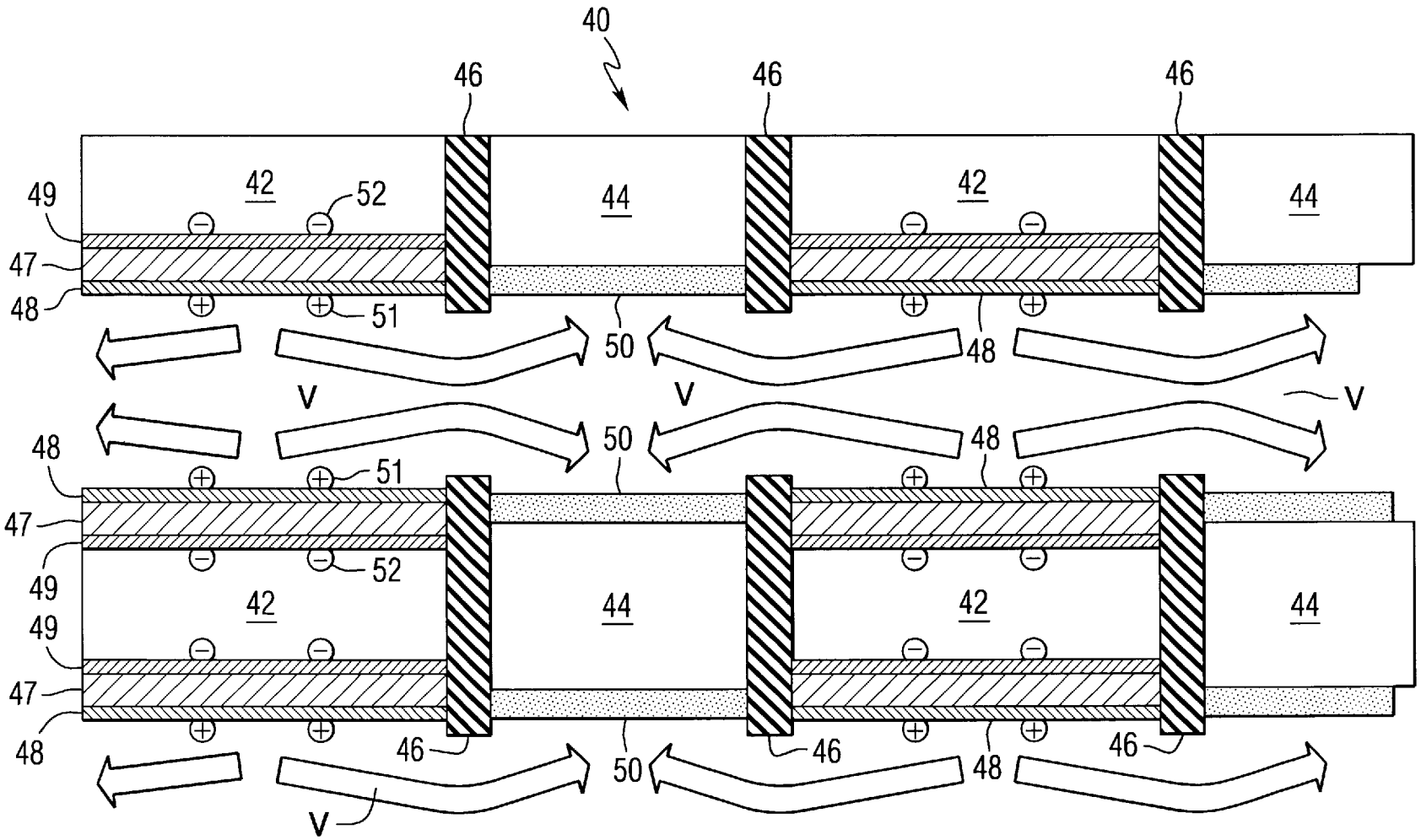
FIG. 3 is a schematic diagram of a parallel condenser AMTEC that may be used in accordance with another embodiment of the present invention.

FIG. 3 schmatically illustrates a parallel condenser system 40 which may be incorporated in AMTEC systems in accordance with a preferred embodiment of the invention. The parallel condenser system 40 includes several high temperature regions or channels 42 which contain high temperature and high-pressure working fluid, and several low temperature cooling regions or ducts 44 which contain coolant. The high temperature and pressure working fluid contained within the high temperature channels 42 preferably comprises liquid metal such as sodium, potassium or lithium. The coolant contained within the low temperature cooling regions or ducts 44 preferably comprises water, air, inert gas or liquid metal. Insulating walls 46 separate the high temperature and low temperature regions 42 and 44. The insulating walls 46 are preferably made of external layers of electrical insulation and internal thermal insulation comprising multifoil.

As shown in FIG. 3, the parallel condenser system 40 includes several electrolyte layers 47 sandwiched between current collector or electrode layers 48 and 49. The electrode layers 48 oppose each other and are separated by at least one vapor chamber V. The layers 48 have relatively hot surfaces due to their proximity to the high temperature channels 42. Several opposing return wicks 50 having relatively cool surfaces are separated from each other adjacent to the lower temperature cooling regions or ducts 44. Working fluid is vaporized in the chamber V near the hot surfaces 48, and then flows to the cooler surfaces 50 where it is condensed. As shown in FIG. 3, the high temperature channels 42 are positioned such that they face each other across the vapor chamber V, while the low temperature regions 44 are similarly positioned to face each other.

The parallel condenser system 40 as shown in FIG. 3 minimizes thermal radiation and pressure losses inside the AMTEC modules. The high pressure/high temperature working fluid is supplied axially through the channels 42 formed by the electrode/electrolyte/electrode sandwiches 48/47/49, with the insulating walls 46 on the sides, as illustrated in FIG. 3. Electrons are conducted from and to the electrodes 48 and 49 by electric leads 51 and 52 located on their surfaces. In the case of a liquid fed AMTEC, the negative electrodes 49 and leads 51 are not needed. The low-pressure working fluid vapor flows in a direction perpendicular to the feed channels 42 and condenses on the sides of the cooling ducts 44. The low temperature liquid flows back to the heating region through the return wicks 50. The condenser surface is preferably located In substantially the same geometrical plane as the electrolyte, as shown in FIG. 3.

The thermoelectric devices suitable for use in the present hybrid combustion power system directly produce electric power from thermal energy using the bound electrons in a material. In metals and semiconductors, electrons and holes are free to move in the conduction band. These electrons respond to electric fields, which establish a flux of charges or current. They can also respond to a gradient in temperature so as to accommodate a flow of heat. In either case, the motion of the electrons transports both their charge and their energy.

The present thermionic energy converter devices also convert heat into electricity without moving parts. Such devices include a hot electrode or emitter facing a cooler electrode or collector inside a sealed enclosure containing electrically conducting gases. Electrons vaporized from the hot emitter flow across the electrode gap to the cooler electrode, where they condense and then return to the emitter via the electrical load. The temperature difference between the emitter and collector drives the electrons through the load. Various geometries are possible, for example, with electrodes arranged as parallel planes or as concentric cylinders.

In the AMTEC devices used in the present hybrid combustion power system, heat is used to drive a current of ions across a barrier. The flow of a hot material and its energy to a state of lower energy causes the electrons that are created in the process to carry the energy to a load. AMTECs are high efficiency, static power conversion devices for the direct conversion of thermal energy from a variety of sources to electrical energy. Examples of AMTECs which may be suitable for use in the present hybrid system are disclosed in U.S. Pat. Nos. 4,808,240 and 5,228,922, which are incorporated herein by reference. Some AMTEC devices utilize beta aluminum solid electrolyte (BASE), which is an excellent sodium ion conductor, but a poor electron conductor. Electrons can therefore be made to pass almost exclusively through an external load.

One type of AMTEC which may be used in accordance with the present invention includes multiple tubular cells, as disclosed in U.S. Pat. No. 5,228,922. Each tubular cell comprises a rigid porous tubular base portion and a wicking portion disposed on one of the major surfaces of the tubular base portion. The wicking portion has a tab, which extends downwardly below the tubular base portion. The cell also comprises a barrier, which is impervious to the alkali metal, is an electron insulator, is a conductor of alkali metal ions, and is disposed on the other major surface of the tubular base portion. A conductor grid over lays the barrier. A first electrical lead is electrically connected to the wicking portion and a second electrical lead is electrically connected to the conductor gird. The first electrical lead of one tubular module is electrically connected to the second electrical lead of an adjacent tubular module, electrically connecting the tubular modules in series. The thermal electric converter also comprises a vessel enclosing the modules therein. A tube sheet is disposed in the vessel for dividing the vessel into two portions, for receiving the tubular modules, for providing electrical isolation between all of the modules and for cooperating with the barrier to form a pressure/temperature barrier between the two portions, a high pressure high temperature portion and a lower pressure low temperature portion. Molten alkali metal is disposed in the high-pressure high temperature portion of the vessel. The lower end of the tab of the wicking material is disposed above the alkali metal in the high pressure high temperature portion of the vessel allowing the individual modules to drain excess alkali metal into the same area of the vessel and remain electrically isolated. The converter further comprises means for heating the alkali metal in the high pressure high temperature portion of the vessel, means for condensing alkali metal vapor disposed in the low pressure low temperature portion of the vessel, and means for pumping alkali metal form the low pressure low temperature portion of the vessel to the high pressure high temperature portion of the vessel for converting thermal energy into high voltage electrical energy.

The present hybrid combustion power system for topping cycle and stand alone power system applications provides several advantageous features. The combustion air is continuously preheated by the waste heat of the low and high temperature direct energy conversion devices before entering a burner and then the turbine. The waste heat not recovered by the combustion air may optionally be passed to a second low temperature device or Rankine cycle. In a preferred embodiment, the AMTEC working fluid is heated in a counter flow gas-liquid metal heat exchanger to achieve isothermal AMTEC operation and maximum efficiency. The AMTEC condenser is preferably located in substantially the same geometrical plane as the electrolyte and thermally insulated from the electrolyte, thus reducing thermal radiation and pressure losses.

The disclosed system has potential applications to new and repowered fossil-fueled plants. The operating temperatures for the direct-conversion devices are appropriate for application in fossil-fueled power plants. Combustion temperatures of fossil fuels are typically higher than 1590 K (2,400° F.), while steam generators rarely operate above 870 K (1,100° F.). Since direct-conversion devices operate in this previously unused temperature range between combustion and steam cycle input, the efficiency of the proposed hybrid system is potentially higher than the efficiency of conventional coal-fueled steam plants.

Figure 4:
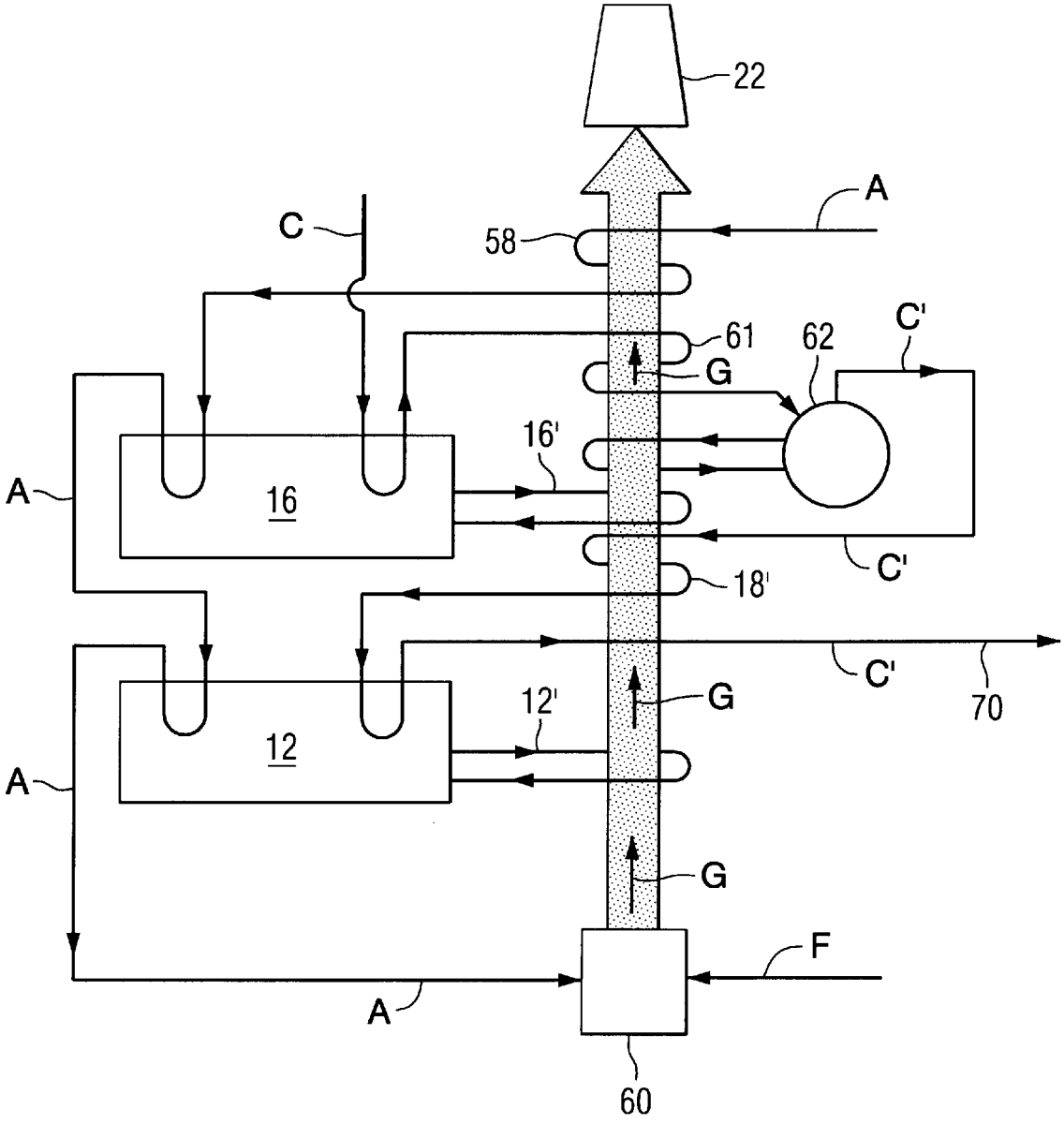
FIG. 4 is a flow diagram showing in more detail the schematic diagram of FIG. 1.

Referring now to FIG. 4, which is a flow diagram showing in more detail the schematic diagram of FIG. 1, with the addition of an economizer loop 61, a boiler 62, and a superheater loop 18'. Here, low-temperature AMTEC device 16, containing a heating loop 16', generates electric power from the temperature difference between the hot combusted gas G and the cooler water C and combustion air A, and high-temperature AMTEC device 12, containing heating loop 12', generates electric power from the temperature difference between the hot combusted gas G and the cooler steam C' and combustion air A.

Waste heat from the two AMTEC devices is used to heat combustion air, feedwater, and steam. The combustion air A receives waste heat from the combusted gas G, in a preheater loop 58, as a result of combustion air A and fuel F, in a furnace or the like 60. The pre-heated combustion air A then passes to low-temperature AMTEC device 16 and high-temperature AMTEC device 12 where the combustion air A is further heated. Cooling medium C, such as water, flows into the low-temperature AMTEC device 16, is further heated by combusted gas in an economizer loop 61, becomes steam C' in boiler 62, is superheated at loop 18' and in high-temperature AMTEC device 12, and thereafter passes to the steam cycle and steam turbine in stream 70. Thus, rejected heat from the two AMTEC devices is used to heat feedwater, superheat steam and pre-heat combustion air. In this configuration, the thermionic or high-temperature AMTEC device 12 aids superheater 18', and the low-temperature AMTEC or thermionic device 16 aids economizer 61 and air preheater 58. Combusted gas stack is shown as 22.

Figure 5:
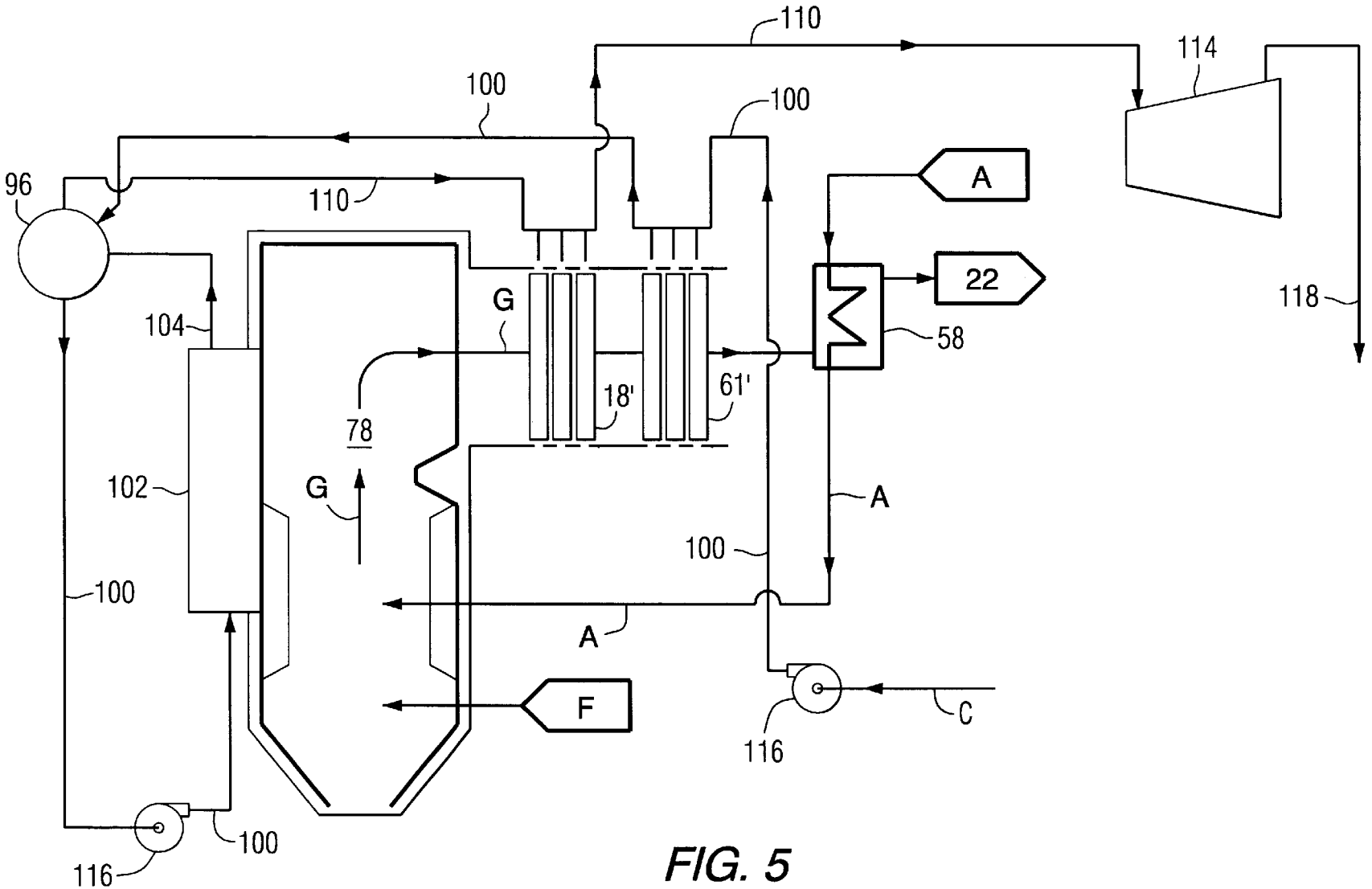
FIG. 5 shows a flow diagram of one type of hybrid AMTEC-Rankine system that uses AMTEC rejected heat to generate steam.

FIG. 5 illustrates the retrofit application of AMTEC to an existing Rankine steam cycle with turbine 114. Referring to FIG. 5, AMTEC device 102 generates power by converting the temperature difference between the air A and fuel F, combusted gases G in the fossil boiler 78 and circulating water 100 from feedwater source C into electric power. In addition, waste heat from AMTEC device 102 heats circulating water 100 to a higher temperature, stream 104, increasing the quantity of steam 110 produced by the steam drum 96. Pumps are shown as 116, fuel as F, air preheater as 58, economizer as 61', superheater as 18', and the exit stack as 22. Steam in line 118 passes to a condenser.

Whereas particular embodiments of this invention have been described above for purposes of illustration, it will be evident to those skilled in the art that numerous variations of the details of the present invention may be made without departing from the invention as defined in the appended claims.

What is claimed is:

1. A hybrid combustion power system comprising:

a source of combustion air, combustion fuel, and coolant;

at least one direct energy thermionic converter power generator for heating at least one of the combustion air and coolant;

a steam turbine to which any heated coolant passes;

a high temperature thermionic converter; and a low temperature thermionic converter, wherein the low and high temperature thermionic converters are heated by a stream of combusted air and fuel.

2. The hybrid combustion power system of claim 1, wherein the low temperature thermionic converter is an alkali metal thermoelectric converter (AMTEC) and operates at a temperature of from about 600 K to about 1,300 K.

3. The hybrid combustion power system of claim 1, wherein the high temperature thermionic converter is an alkali metal thermoelectric converter (AMTEC) and operates at a temperature of from about 1,300 K to about 2,500 K.

4. The hybrid combustion power system of claim 1, further comprising a second low temperature thermionic converter for receiving waste heat from at least one of the low and high temperature thermionic converters.

5. The hybrid combustion power system of claim 4, wherein the second low temperature thermionic converter comprises an alkali metal thermoelectric converter (AMTEC), thermoelectric converter, or thermophotovoltaic converter.

6. A hybrid combustion power system comprising:

a source of combustion air, combustion fuel, and coolant;

at least one direct energy thermionic converter power generator for heating at least one of the combustion air and coolant;

a steam turbine to which any heated coolant passes, wherein the at least one thermionic converter comprises an alkali metal thermoelectric converter (AMTEC).

7. The hybrid combustion power system of claim 6, wherein the alkali metal thermoelectric converter (AMTEC) comprises a parallel condenser.

8. A hybrid combustion power system comprising:

a source of combustion air, combustion fuel, and coolant;

at least one direct energy thermionic converter power generator for heating at least one of the combustion air and coolant;

a steam turbine to which any heated coolant passes, wherein the direct energy thermionic converter power generator, is an alkali metal thermoelectric converter (AMTEC), combustion air is passed through an air heater prior to the heating of the combustion air by the AMTEC, the heated air from the AMTEC combusts with combustion fuel to provide combusted gases which heat the AMTEC, a water coolant is used and it is converted to steam by the AMTEC, which steam is passed to the steam turbine.

9. The hybrid combustion power system of claim 8, wherein the combusted gases preheat combustion air and further heat coolant.

10. A parallel condenser system for an alkali metal thermoelectric converter (AMTEC) comprising:

multiple opposing high temperature working fluid regions separated from each other by at least one vapor chamber; and multiple opposing low temperature coolant regions separated from each other by the at least one vapor chamber, and separated from the high temperature working fluid regions by insulating walls.

* * * * *